US009927204B1

(12) United States Patent
Rosa

(10) Patent No.: US 9,927,204 B1
(45) Date of Patent: Mar. 27, 2018

(54) ARCHER FINGER SLING ASSEMBLY

(71) Applicant: Adriano Rosa, Caledonia, MI (US)

(72) Inventor: Adriano Rosa, Caledonia, MI (US)

(73) Assignee: NoTork, LLC, Lowell, MI (US)

( * ) Notice: Subject to any disclaimer, the term of this patent is extended or adjusted under 35 U.S.C. 154(b) by 0 days.

(21) Appl. No.: 15/446,739

(22) Filed: Mar. 1, 2017

(51) Int. Cl.
*F41B 5/14* (2006.01)

(52) U.S. Cl.
CPC ..... *F41B 5/1473* (2013.01); *F41B 5/14* (2013.01)

(58) Field of Classification Search
CPC ..... F41B 5/00; F41B 5/14; F41B 5/1473
See application file for complete search history.

(56) References Cited

U.S. PATENT DOCUMENTS 3,103,213 A * 9/1963 Robinson ..... F41B 5/14 124/1
3,204,626 A * 9/1965 Morneau ..... F41B 5/14 124/23.1
3,415,241 A * 12/1968 Bear ..... F41B 5/0031 124/23.1
3,572,312 A * 3/1971 Foster ..... F41B 5/14 124/23.1
4,175,536 A * 11/1979 Carella ..... F41B 5/14 124/23.1
4,714,071 A * 12/1987 Saunders ..... F41B 5/14 124/88
4,777,666 A * 10/1988 Beverlin ..... F41B 5/1473 124/88
4,836,177 A * 6/1989 Williams ..... F41B 5/14 124/88
5,070,856 A * 12/1991 Plummer ..... F41B 5/1473 124/23.1
5,081,979 A * 1/1992 Burling ..... F41B 5/14 124/23.1
5,333,595 A * 8/1994 Heffron ..... F41B 5/0052 124/23.1
5,617,838 A * 4/1997 Peruski ..... F41B 5/14 124/88

* cited by examiner

*Primary Examiner* — John Ricci
(74) *Attorney, Agent, or Firm* — Frank M. Scutch, III

(57) ABSTRACT

A finger sling assembly used with an archery bow includes a first finger loop for engaging within a user's finger and a second finger loop for engaging within the user's thumb. A connecting member joins the first finger loop and second finger loop together a predetermined distance from one another. A fastening strip is sized to be positioned though the first finger loop and second figure loop, for fixedly attaching the first finger loop and second finger loop to an archery bow. A multi-layered orthotic is used for fastening to the bow's riser. The finger sling assembly increases shooting accuracy of the archer as it prevents rotational torque of the user's wrist when tightly gripping the bow and drawing string.

20 Claims, 5 Drawing Sheets

ARCHER FINGER SLING ASSEMBLY

FIELD OF THE INVENTION

The present invention relates generally to an archery bow and more specifically to a finger sling used by an archer with an archery bow.

BACKGROUND

Archery is practiced both as a hunting technique and a recreational sport activity. In both scenarios, accuracy is of the utmost importance. Using bow sites and mechanical releases can help, but they are relatively ineffective if the archer cannot find and maintain a proper shooting position at full draw and release. It is the process of finding and maintaining this proper shooting position that leads to accurate shooting for most archers.

In practicing archery, maintaining the bow in the line of the shot from the release of the bow string until the notch end of the arrow has passed the bow is critical to the accuracy of the shot. When the bow is drawn with no torque applied through the grip, the arrow direction and the sighting direction coincide. However, when torque is applied to a drawn bow, the arrow parallels the sighting direction, but the bow is aimed in the direction of the applied torque. This results in changing the direction of the bow, thereby effecting the accuracy of the shot. Thus, it is preferable to minimize any torque applied by the archer to the bow.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
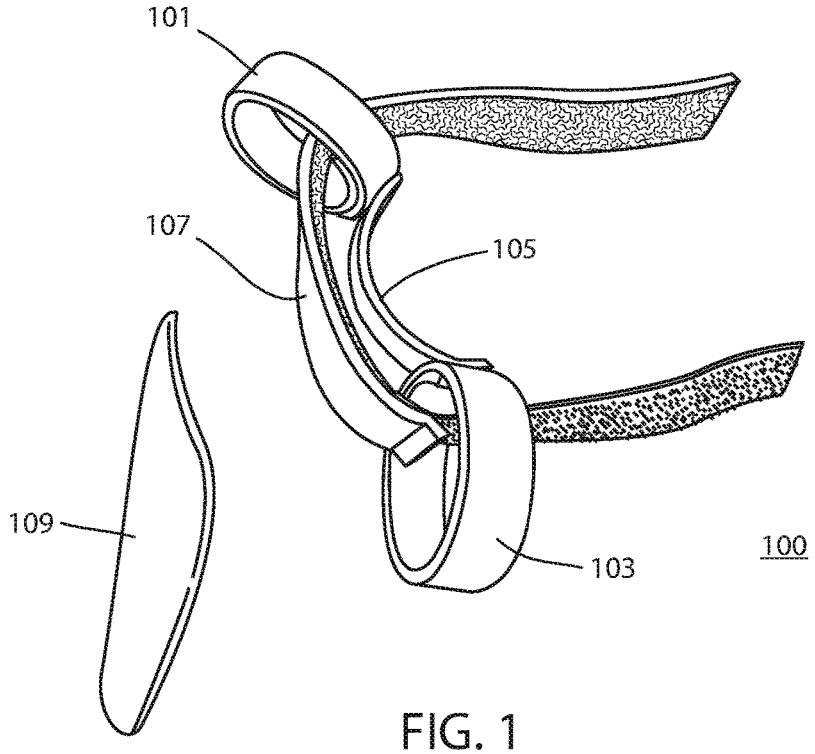
FIG. 1 is a perspective view of the finger sling illustrating an accompanying palm orthotic and shim section.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to archer finger sling. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It is an object of the invention to provide a finger sling that is configured about the riser of the bow using a hook and loop strap so that the finger sling does not impart torque to the bow during the shot. FIG. 1 is a perspective view illustrating the finger sling used in connection with the user's thumb and index finger. The finger sling assembly 100 includes a first loop which typically will be for the user's thumb if they are right handed. A second loop can be used for the user's index finger or middle finger. The loop 101 and loop 103 are sized both length and diameter so that an end doubles or extends over itself and is secured together. The overall length of loop 101 and loop 103 is sized to configure to the user's hand. For example, women and youth will have smaller fingers than men and consequently would likely feel more comfortable using smaller diameter loops.

As seen in FIG. 1, the finger sling assembly 100 further includes a connecting member 105 that joins the first loop 101 and second lop 103 at a fixed distance of separation. The connecting member 105 connects to the loop 101 and loop 105 at the point of overlap so to increase the overall connection strength. The connecting member 105 is typically formed with a bowed shape as this allows the connecting member to better conform to the shape of the bow riser during use. Since the connecting member 105 engages with the bower riser, this provides a better grip with less slippage for avoiding the necessity to retighten the finger sling 100 to the bow while in use. A fastening strip 109, is sized to be positioned though the first finger loop 101 and second figure loop 103 and is used for fixedly attaching the first finger loop 101 and second finger loop 103 to a riser on the archery bow. The fastening strip 109 is typically manufactured of a hook and loop fastener material and is fastened around the riser in a manner to avoid slippage.

Finally, the finger sling system 100 includes a palm orthotic 109 that can be used in combination with the finger sling. The orthotic 109 is a substantially triangular shaped pad with a convex surface. The orthotic 109 is sized to fit the surface of bow's riser at the location where the user's hand would contact the riser. The orthotic 109 is positioned narrow side up, so the wide portion of the orthotic fits in the upper portion of the user's hand closest to the thumb. The orthotic 109 is typically fastened to the riser using a glue or adhesive tape and works to comfortably hold the user's palm into a predetermined position during use of the bow without slippage. This prevents rotation or a torque like movement of the user's wrist that will affect the user's aim. Those skilled in the art will recognize that loop 101, loop 103, fastening strop 105 and orthotic 109 can be made of a flexible rubberized material such as rubber, neoprene or the like. This type of material is flexible while repealing both water and dirt.

Figure 2:
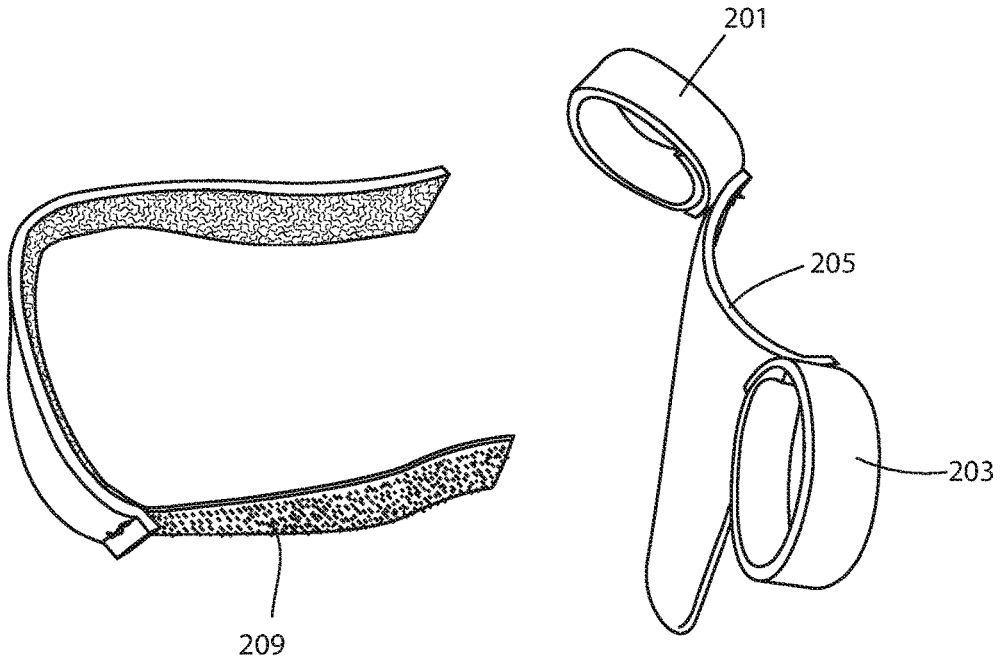
FIG. 2 is a side view illustrating the finger sling attached to an archery bow.

FIG. 2 is a perspective view illustrating an alternative embodiment where the finger sling with integrated orthotic. The finger sling 200 includes a first finger loop 201 for the user's middle finger or index finger and a second finger loop 203 for the user's thumb. A connecting member 205 joins and bridges the finger loop 201 and finger loop 203 so they are a fixed distance apart. The orthotic 207 is configured into a substantially triangular shape so that its wide end is fastened and connects to the connecting member 205. The orthotic 207 has a convex shape so the bowed portion of the orthotic rests and is in contact with the contour of the bow's riser. Finally, a fastening strap 209 is made of a hook and loop material and is used to fasten the finger sling 200 to the bow by passing though the finger loop 201, finger loop 203 and being fastened around the bow to hold it in to a fixed position.

Figure 3:
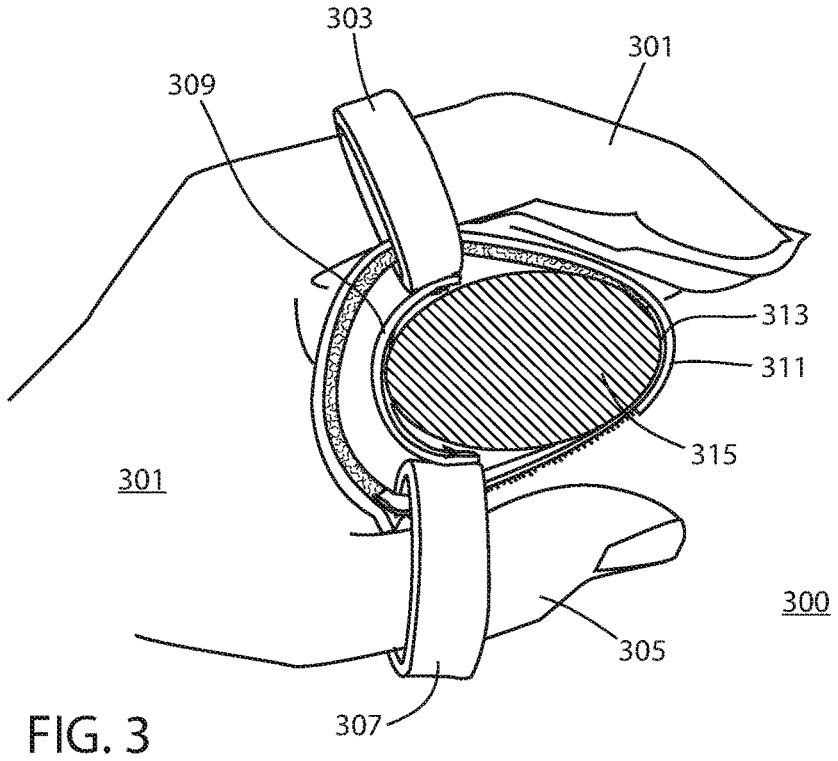
FIG. 3 is a top view illustrating the finger sling used in connection with the user's thumb and index finger.

FIG. 3 is a top view illustrating the finger sling used in connection with the user's thumb and index finger. The finger sling 300 is illustrated as used with a user's hand 301 where the user's index finger 301 is poisoned though the first loop 303. The user's thumb 305 is positioned though the second loop 307. The connecting member 309 is shown joining both the first loop 203 and second loop 307. The fastening strip 313 is configured to pass though both the first loop 303 and second loop 307 while fastening to itself on the distal end 313 of the bow's riser 315.

Figure 4:
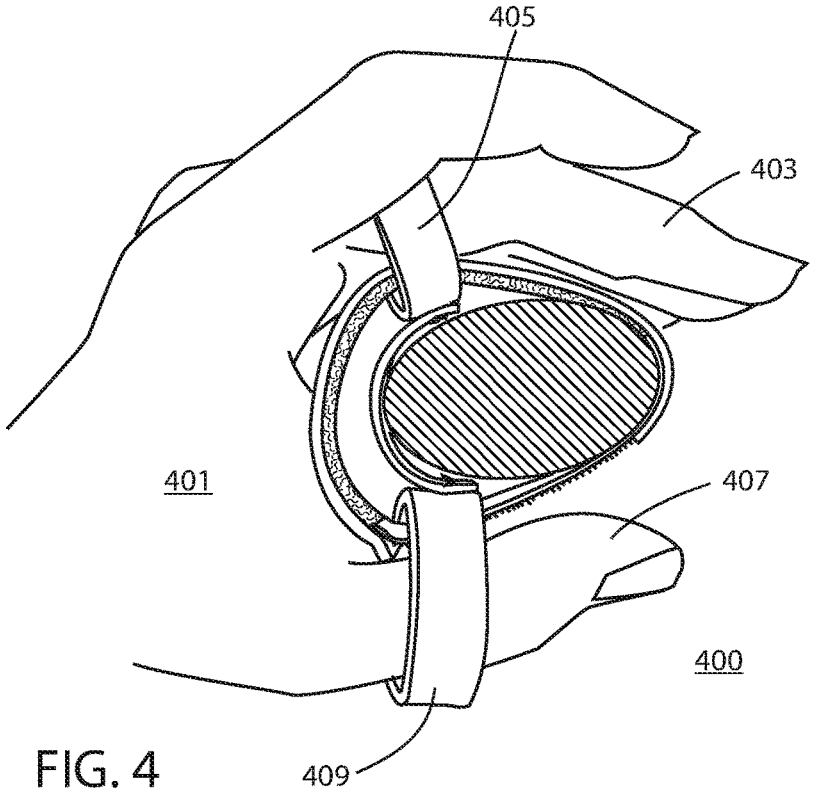
FIG. 4 is a top view illustrating the finger sling used in connection with the user's thumb and middle finger.

FIG. 4 is a perspective view of an alternative embodiment illustrating the finger sling used in connection with the user's thumb and middle finger. The finger sling 400 is shown where the user's hand 401 is positioned so that the middle finger 403 passes through the first loop 405 and the thumb 407 passes through the second loop 409. The finger sling 400 attaches to the bow's riser as described with regard to FIG. 3. This embodiment may be used where the user find more confirm in using their larger middle finger.

Figure 5:
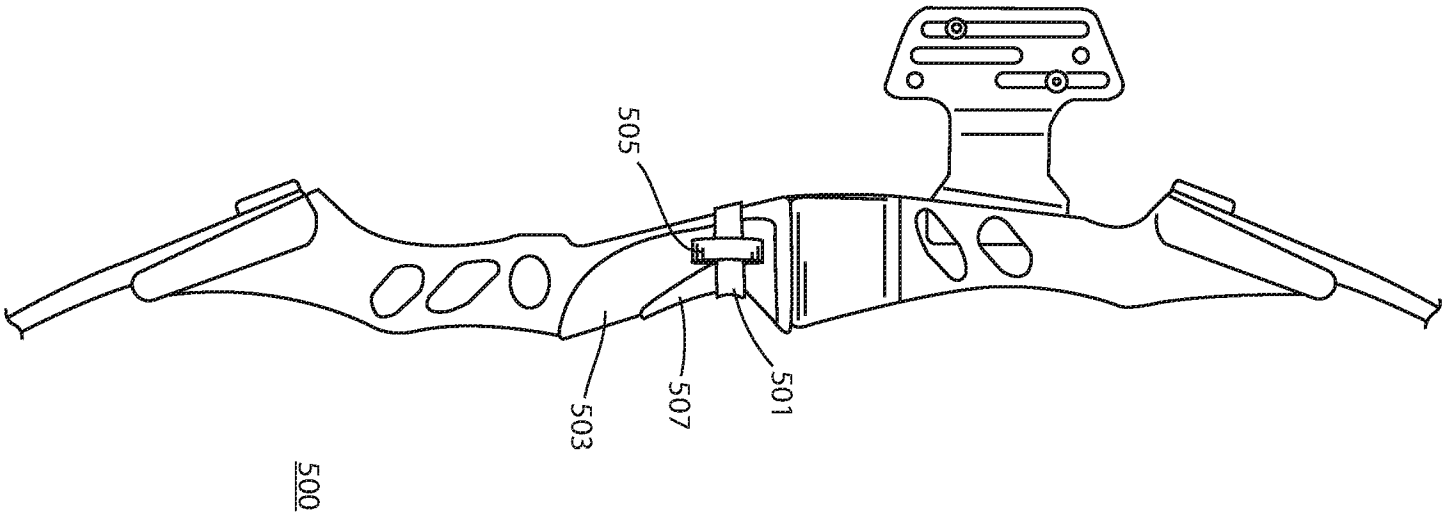
FIG. 5 is a side view of the finger sling illustrating the finger sling assembly installed on an archery bow.

FIG. 5 is a side view of the finger sling illustrating the finger sling assembly installed on an archery bow. The finger sling assembly 500 is shown where the fastening strap 501 is positioned around the riser 503. The first loop 505 is configured to accept either user's index finger or middle finger. The orthotic 507 is poisoned so that it convex shape is configured inwardly, toward the riser 503, so that it adheres to its shape.

Figures 6A, 6B:
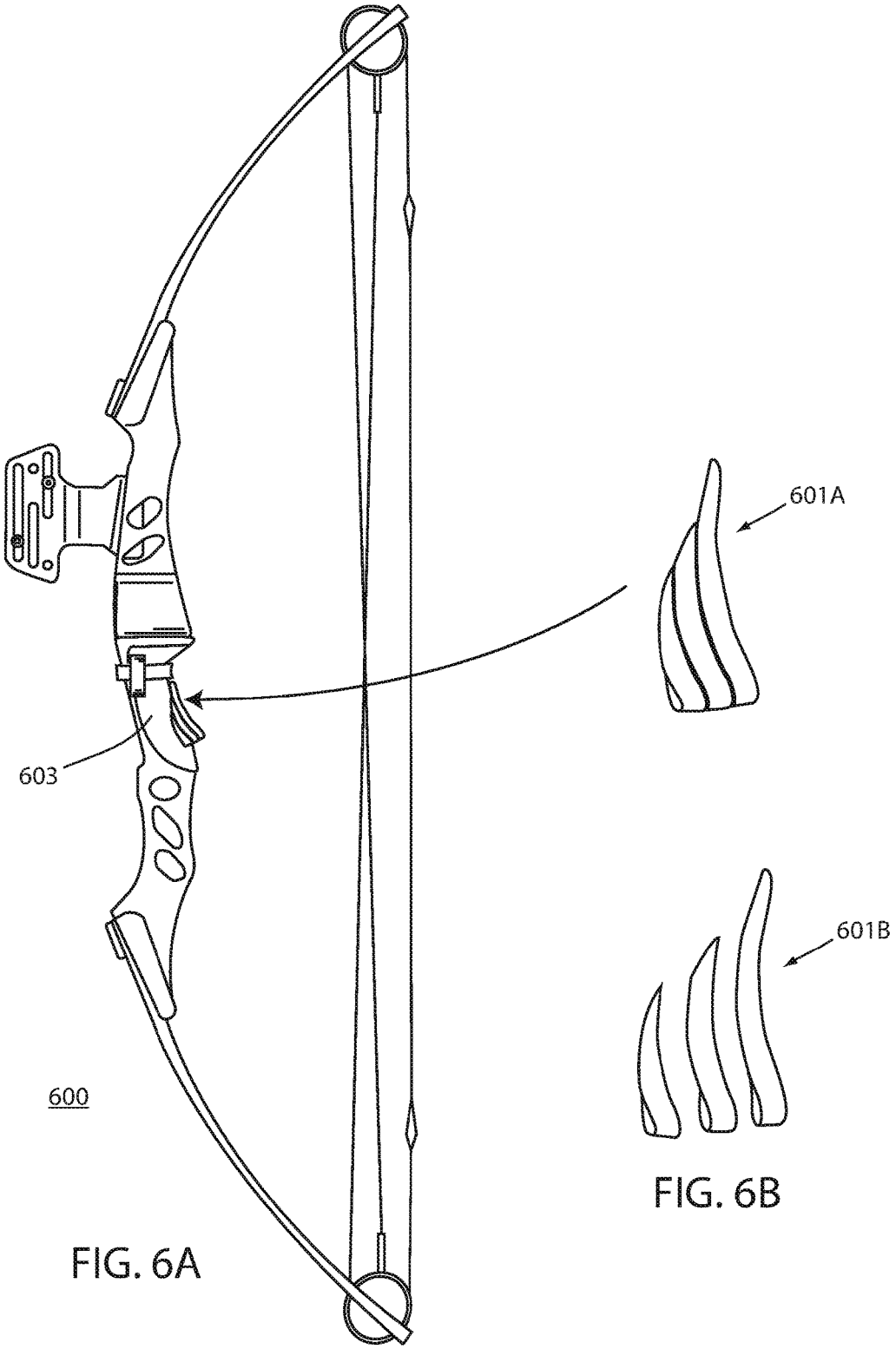
FIG. 6A is a side view illustrating the palm orthotic installed on the archery bow.
FIG. 6B is an exploded view of the multi-layered orthotic.

FIG. 6A is a side view illustrating the finger sling assembly used with the palm orthotic installed on the archery bow as used with an orthotic having one or more shims. The finger sling assembly 600 includes a multi-layered orthotic 601A where each layer may be separated or peeled apart so to select a desired width and thickness of the orthotic. FIG. 6B shows an exploded view of the orthotic 601B having multiple sizes and layers that can be selected by the user for the best comfort. Those skilled in the art will recognize that the layer contacting the riser 603 is adhered to the riser 603 and is positioned under the orthotic 601 touching the user's palm. The position of the orthotic 601A is selected to take up the gap or space under the user's palm and can be fixedly attached to the riser 603 for user comfort. The multi-layered orthotic 601A is used to make approximately ¼ inch adjustments e.g. ¼ inch, ½ inch, ¾ inch, to the portion of the user's palm contacting the riser 603. The finger sling 600 and use of the optional orthotic 601A allows the user to tightly grip of the bow so that it will not torque or twist the user's wrist will counter-force to the bow string is applied.

Figure 7:
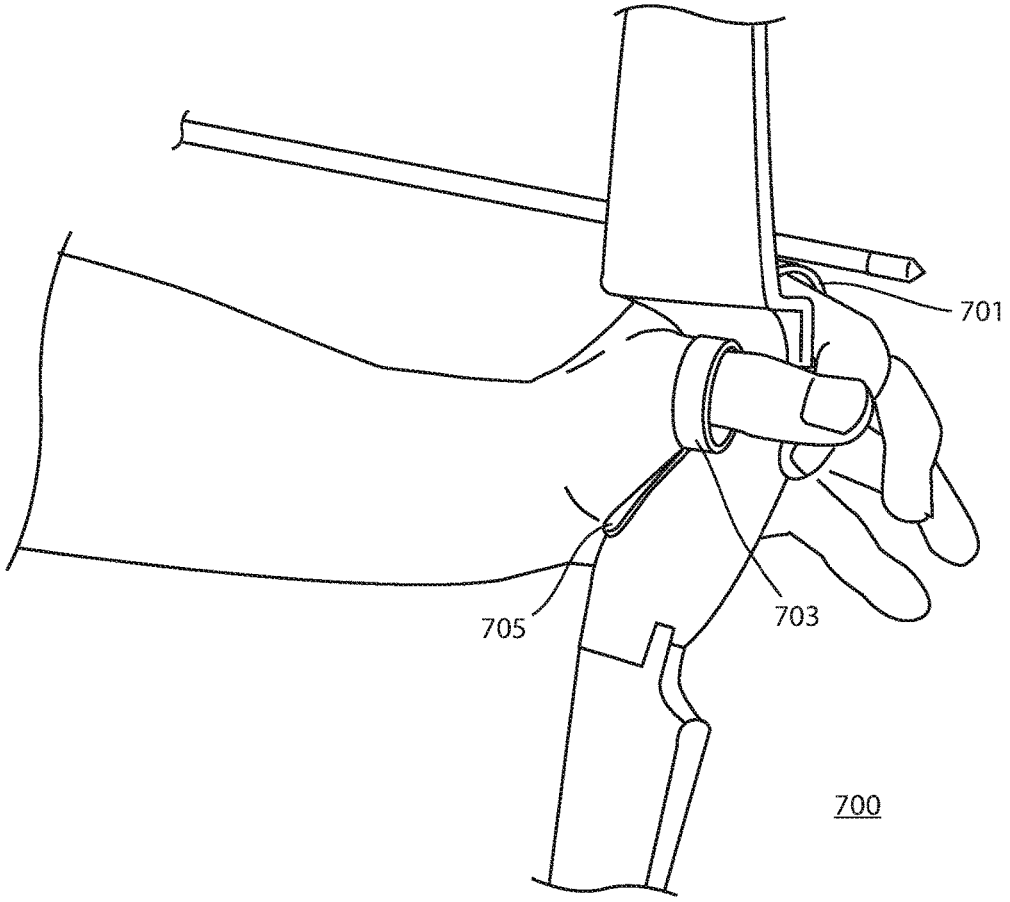
FIG. 7 is a perspective view of a user's hand engaged within the finger sling using the palm orthotic.

Finally, FIG. 7 is a perspective view of the finger sling assembly as configured with the user's hand and palm orthotic. The finger sling 700 is shown where the first loop 702 is engaged with the user's index finger and the second loop 703 is engaged with the user's thumb. The palm of the user's hand is in contact with the orthotic 705. In use, the finger sling assembly 700 allows the users hand to grip the bow more tightly while pulling on the bow string, without rotating the user's wrist supporting the bow that would alter the aim of the arrow.

Thus, an embodiment of the invention is directed to a finger sling assembly for use when gripping an archery bow that includes a first finger loop whose diameter is sized for the index finger or middle finger. A second finger loop whose diameter is also used that is sized for a thumb. A joining member attaches the first finger loop to the second finger loop and sized in length so the first finger loop and second finger loop are a predetermined distance from one another. A fastening loop is configured to loop though the first finger loop and second finger loop for attaching the first finger loop and second finger loop to the archery bow. An orthotic and shim can be attached to the bow a predetermined distance from the first finger loop and second finger loop so to fit within a user's palm and provide comfort and preventing torque when shooting arrows from the bow.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. A finger sling assembly used with an archery bow comprising:

a first finger loop for engaging within a user's finger;

a second finger loop for engaging within the user's thumb;

a connecting member for joining the first finger loop and second finger loop together a predetermined distance from one another; and a fastening strip, configured though the first finger loop and second figure loop, for fixedly attaching the first finger loop and second finger loop to an archery bow by attaching the fastening strip together upon itself around a bow riser to prevent rotation of the user's wrist.

2. A finger sling assembly as in claim 1, further comprising:

an orthotic attached to the archery bow riser at a predetermined distance from the first finger loop and second finger loop for providing a user with a more comfortable grip to the archery bow.

3. A finger sling assembly as in claim 2, wherein the orthotic includes removeable layers for obtaining an optimal comfort with the user's palm.

4. A finger sling assembly as in claim 2, wherein the orthotic is configured into a truncated triangular shape.

5. A finger sling assembly as in claim 2, wherein the orthotic is configured into a convex shape for conforming to the shape of the archery bow.

6. A finger sling assembly as in claim 2, further comprising a shim used with the orthotic for adjusting position of the orthotic in relation to the surface of the bow.

7. A finger sling assembly as in claim 1, wherein the first finger loop is adjustable to work with the user's index finger.

8. A finger sling assembly as in claim 1, wherein the first finger loop is adjustable to work with the user's middle finger.

9. A finger sling assembly as in claim 1, wherein the fastening strip is fastened into a loop around the archery bow using a hook and loop fastener.

10. A finger sling for use when gripping an archery bow comprising:

a first finger loop whose diameter is sized for the index finger or middle finger;

a second finger loop whose diameter is sized for a thumb;

a joining member for attaching the first finger loop to the second finger loop and sized in length so the first finger loop and second finger loop are a predetermined distance from one another;

a fastening loop configured to loop though the first finger loop and second finger loop for attaching the first finger loop and second finger loop to the archery bow by fastening the fastening loop to itself around a bow riser on the archery bow; and an orthotic for attachment a predetermined distance from the first finger loop and second finger loop on the archery bow and configured to fit within a user's palm for preventing movement of the user's palm.

11. A finger sling as in claim 10, wherein the orthotic includes removeable layers for fitting the orthotic to the user's palm.

12. A finger sling as in claim 10, wherein the fastening loop includes hook and fastener material for tightly configuring the fastening loop around the archery bow.

13. A sling as in claim 10, wherein the first finger loop and second finger loop are made of an elasticized material for comfortable fit.

14. A sling as in claim 10, wherein the orthotic is convex in shape to wrap around a portion of the archery bow.

15. A sling as in claim 10, wherein the orthotic uses a shim for adjusting the position of the orthotic in relation to the surface of the bow for user comfort.

16. A method of forming a finger sling assembly for use with an archery bow comprising the steps of:

forming a first loop for a user's index or middle finger;

forming a second loop for a user's thumb;

joining the first loop and second loop using a connecting member; and forming a fastening loop configured though the first loop and second loop for fastening the first loop and second loop to the archery bow by fastening the fastening loop upon itself around a bow riser on the archery bow.

17. A method of forming a finger sling assembly as in claim 16, further comprising the step of;

utilizing a multi-layered orthotic positioned on the bow so that the user's palm contacts the orthotic for preventing movement of the user's palm while seated on a grip.

18. A method of forming a finger sling assembly as in claim 17, further comprising the step of:

adjusting the thickness of the orthotic so that it configures to the user's palm.

19. A method of forming a finger sling as in claim 17, further comprising the step of:

forming the orthotic into a truncated triangular shape.

20. A method of forming a finger sling as in claim 17, further comprising the step of:

affixing the orthotic to the bow riser using an adhesive.

* * * * *